US007633449B2

(12) United States Patent
Oh et al.

(10) Patent No.: US 7,633,449 B2
(45) Date of Patent: Dec. 15, 2009

(54) WIRELESS HANDSET WITH IMPROVED HEARING AID COMPATIBILITY

(75) Inventors: Sung-Hoon Oh, Tamarac, FL (US); Carlo Dinallo, Plantation, FL (US); Mattia Pascolini, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 47 days.

(21) Appl. No.: 12/040,455

(22) Filed: Feb. 29, 2008

(65) Prior Publication Data

US 2009/0219214 A1 Sep. 3, 2009

(51) Int. Cl.
*H01Q 1/24* (2006.01)

(52) U.S. Cl. ..... 343/702

(58) Field of Classification Search ..... 343/702, 343/700 MS, 841, 846–848, 895; 455/247
See application file for complete search history.

(56) References Cited

U.S. PATENT DOCUMENTS

2006/0293078 A1* 12/2006 Qi et al. ..... 455/552.1
2007/0229372 A1* 10/2007 Desclos et al. ..... 343/702
2007/0247389 A1* 10/2007 Qi et al. ..... 343/842
2009/0085812 A1* 4/2009 Qi et al. ..... 343/702
2009/0143040 A1* 6/2009 Man et al. ..... 455/274

OTHER PUBLICATIONS

Ponce De Leon, Lorenzo, "iDEN Subscriber Technology 2005 Fall Antenna Sumposium," iDEN Antenna Lab, Motorola Networks, Motorola, Inc., 2004, 11 pages.

* cited by examiner

*Primary Examiner*—Huedung Mancuso

(57) ABSTRACT

A "candy bar" form factor wireless handset (200) having an internal antenna (222, 306) a bottom end of an main internal circuit board (208) and an auxiliary field shaping conductor (226, 502, 1102, 1304) at a top end of the main internal circuit board (208) behind the an earpiece speaker (104). The field shaping conductor (226, 502, 1102, 1304) is spaced from a ground plane 304) of the main circuit board (208) but is inductively and capacitively coupled to the ground plane (304). The field shaping conductor (226, 502, 1102, 1304) lowers the electric field intensity in front of the earpiece speaker and thereby reduces interference of the wireless handset (200) with hearing aids.

8 Claims, 12 Drawing Sheets

-PRIOR ART-

-PRIOR ART-

-PRIOR ART-

-PRIOR ART-

WIRELESS HANDSET WITH IMPROVED HEARING AID COMPATIBILITY

FIELD OF THE INVENTION

The present invention relates generally to wireless handset antenna systems.

BACKGROUND

Wireless handsets (cellular telephones) can generate interference with hearing aids that leads to audible noise. The Federal Communication Commission (FCC) will soon require that at least some of the wireless handsets offered by each wireless service provider meet certain standards aimed at reducing interference with hearing aids. These Hearing Aid Compatibility (HAC) standards stipulate that the electric and magnetic field strength within at least six squares of a nine square measurement grid centered on the speaker of a qualifying handset and spaced from the handset by 1 centimeter be below predetermined limits. FIG. 1 depicts a "candy bar" form factor wireless handset 100 with the aforementioned nine square measurement grid 102.

It has been found that it is particularly difficult to make "candy bar" wireless handsets that meet the FCC HAC requirements. Most currently available "candy bar" wireless handsets use internal antennas that are located either the bottom or top end of the handsets internal printed circuit board. Examples of internal antennas include the Planar Inverted "F" (PIFA) antenna and the more advanced Folded Inverted Conformal Antenna (FICA). Generally, internal antennas of wireless handsets use the ground plane of the wireless handset's internal circuit board and/or other conductive parts of the handset as a counterpoise in at least some operating bands (e.g., operating bands in the 800 MHz to 900 MHz range). Consequently, high electric field regions occur both near the antenna and at the opposite end of the handset (at the remote end of the counterpoise.) Such high electric fields are problematic for meeting the FCC HAC requirements.

Thus, what is needed is way to control the pattern of electric fields near the earpiece speaker of wireless handsets so that interference with hearing aids will be reduced and the FCC HAC requirements will be met.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
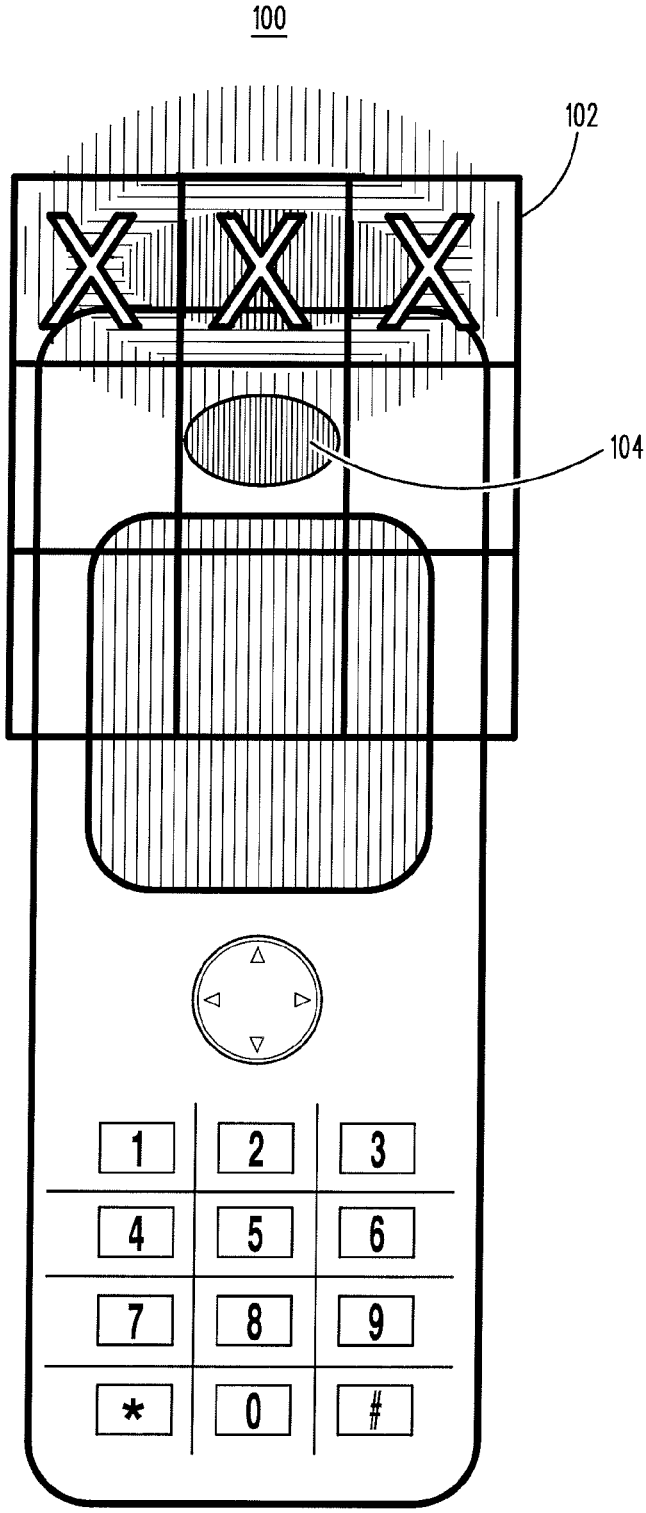
FIG. 1 depicts a "candy bar" form factor wireless handset overlaid with a nine square measurement grid used to define maximum allowable field strength for FCC HAC conformance.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to wireless handsets. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

It will be appreciated that embodiments of the invention described herein may be comprised of one or more conventional processors and unique stored program instructions that control the one or more processors to implement, in conjunction with certain non-processor circuits, some, most, or all of the functions of wireless handsets described herein. The non-processor circuits may include, but are not limited to, a radio receiver, a radio transmitter, signal drivers, clock circuits, power source circuits, and user input devices. As such, these functions may be interpreted as steps of a method to perform wireless communication. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

FIG. 1 depicts a "candy bar" form factor wireless handset 100 overlaid with a nine square measurement grid 102 used to define maximum allowable field strength for FCC HAC conformance. The wireless handset 100 includes an earpiece speaker 104 and the nine square measurement grid 102 is centered 1 cm above the earpiece speaker 104. The position of the grid 102 corresponds roughly to position of a hearing aid when the handset 100 is held to a hearing impaired user's ear. The FCC HAC requirements for the 850 MHz band stipulate that the electric field is not to exceed 48.5 dBV/meter and the magnetic field is not to exceed −1.9 dBA/meter in the measurement grid, with the exception that preceding limits may be exceed within any three grids squares forming a contiguous area, not including the center square of the grid. The contiguous areas for the electric and magnetic fields may be different but must have at least one square in common. Thus for each of the electric and magnetic fields there must be at least a contiguous area made up of six grid squares in which the field limit is met, so that a hearing impaired user can find a position for holding the handset 100 to his or her ear in which audible interference is reduced. Note that in a "candy bar" form factor wireless handset, that uses the ground plane of the main printed circuit board as the antenna counterpoise, the strong electric fields near then end of the handset are more problematic from the stand point of HAC requirements compared to the magnetic field which tend to be stronger near the center of the handset.

Figure 2:
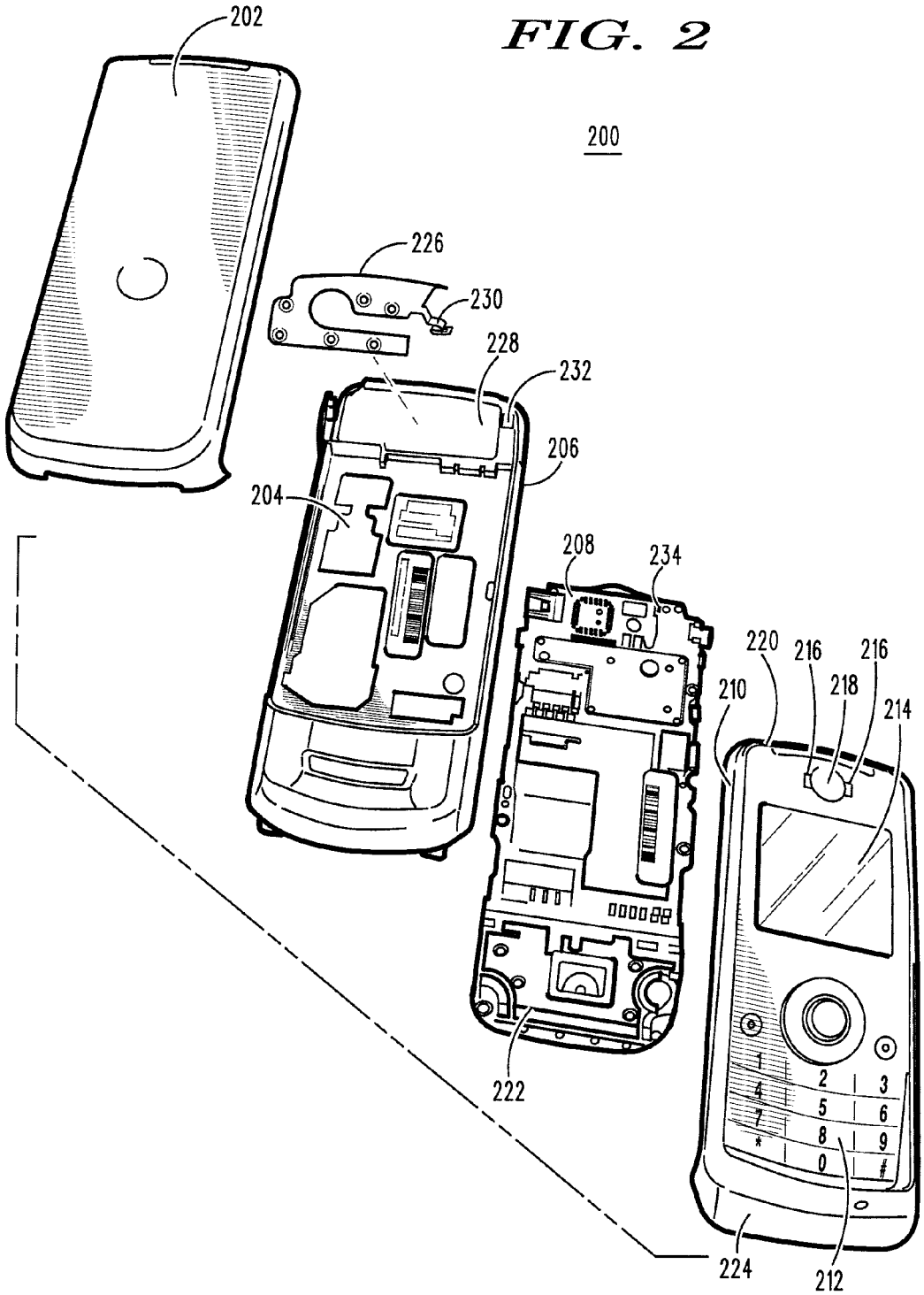
FIG. 2 is an exploded view of a "candy bar" wireless handset according to an embodiment of the invention.

FIG. 2 is an exploded view of a "candy bar" wireless handset 200 according to an embodiment of the invention. Referring to FIG. 2 the handset 200 includes a battery cover 202 which covers a battery compartment 204 in a rear housing part 206. A main printed circuit board 208 for the handset 200 is located between rear housing part 206 and a front housing part 210. The front housing part 210 carries a keypad 212 and includes a display window 214. Earpiece speaker ports 216 are located on either side of a logo medallion 218. The earpiece speaker itself is located on the front of the main printed circuit board 208 and is not visible in FIG. 2. The earpiece speaker ports 216 and the earpiece speaker itself are located proximate a top end 220 of the handset 200. An internal FICA antenna 222 is mounted on the main printed circuit board 208 proximate a bottom end 224 of the handset 200. An auxiliary field shaping conductor 226 fits onto a complementary shaped area 228 of the rear housing part 206. In the assembled handset 200 the field shaping conductor 226 is covered by the battery cover 202. The field shaping conductor 226 includes a depending, integrally formed, bridge conductor 230 that in the assembled handset 200 extends through an opening 232 in the rear housing part 206 and makes contact with a conductive pad 234 on the main circuit board 208. The impedance of the bridge conductor 230 is predominantly inductive. Although, as shown the field shaping conductor 226 is located on the outside of the rear housing part 206, alternatively the field shaping conductor 226 is located inside the rear housing part 206. The field shaping conductor 226 conforms to the shape of the rear housing part and so does not require significant additional volume in the handset 200. In the handset 200 the field shaping conductor 226 is made out of a stamped (die formed) piece of sheet metal, however alternatively the field shaping conductor takes the form of a conductive coating or metallization. In embodiments of the invention, additional parts of a handset other than the ground plane of the printed circuit board, such a metal frame of the handset or a metal display bezel can also form part of the ground structure counterpoise for the internal antenna.

Figure 3:
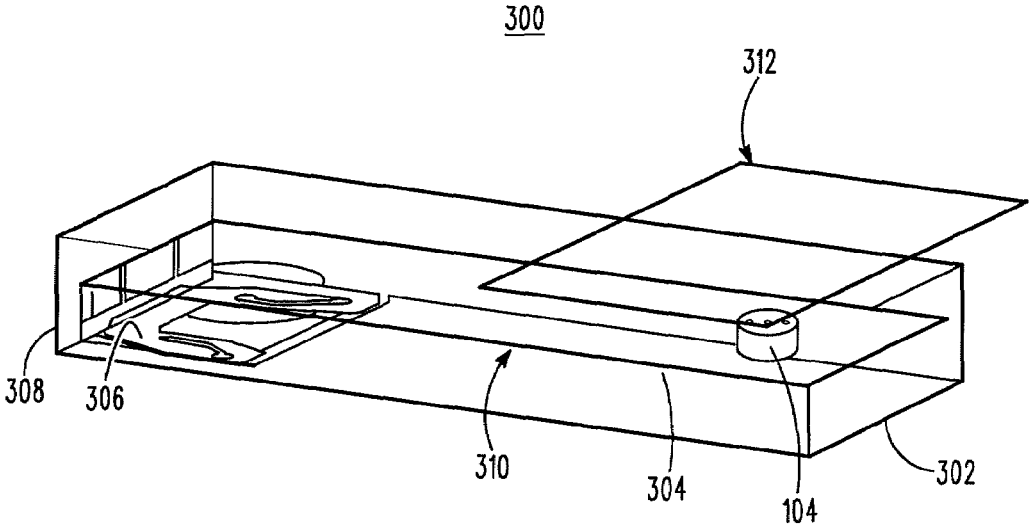
FIG. 3 is a perspective view of an RF simulation model of a "candy bar" wireless handset without a field shaping conductor used in embodiments of the invention.

FIG. 3 is a perspective view of an RF simulation model of a "candy bar" wireless handset 300 without a field shaping conductor used in embodiments of the invention. The RF model handset 300 includes a housing 302 enclosing a ground plane 304 (which in an actual handset would be part of a printed circuit board.) An internal FICA antenna 306 is located at a bottom end 308 of the RF model hand set 300 on a back side 310 (facing away from the user) of the ground plane 304. The FCC HAC measurement surface 312 is also shown in position.

Figure 4:
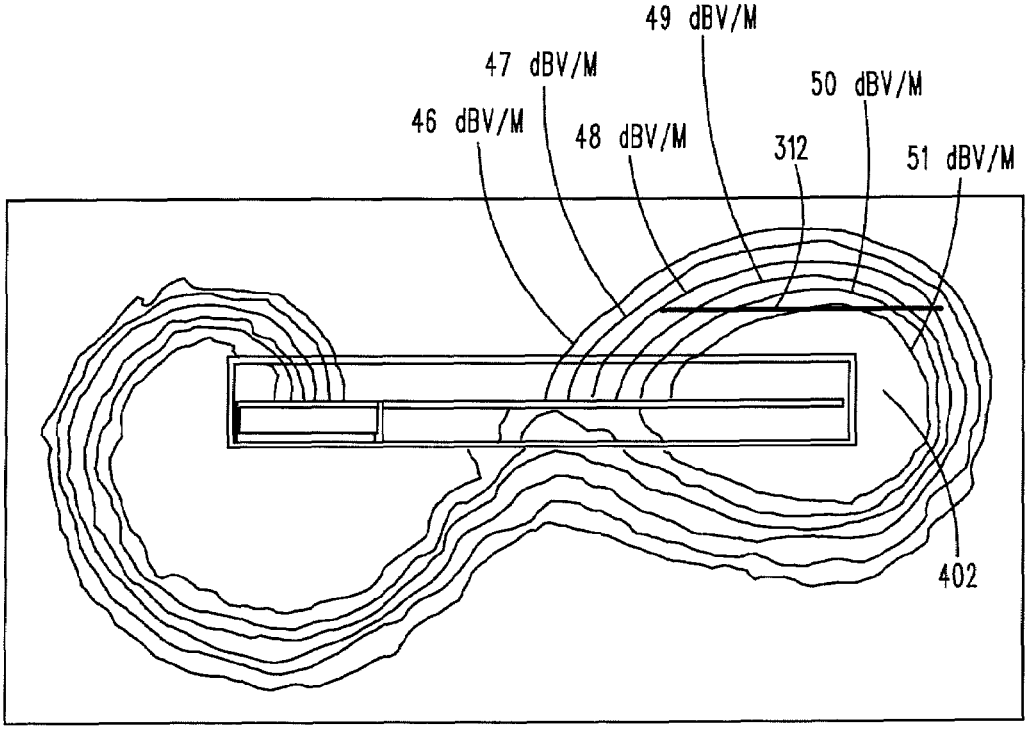
FIG. 4 is a side elevation view of the model shown in FIG. 3 with a superposed contour plot of electric field strength.

FIG. 4 is a side elevation view of the model shown in FIG. 3 with a superposed contour plot of electric field strength. As shown in FIG. 3 a high field region 402 bounded by the contour on which the field strength is 51.4 dBV/m partially overlies the position of the FCC HAC measurement surface 312. In this case the FCC HAC limits on the electric field strength are not met.

Figure 5:
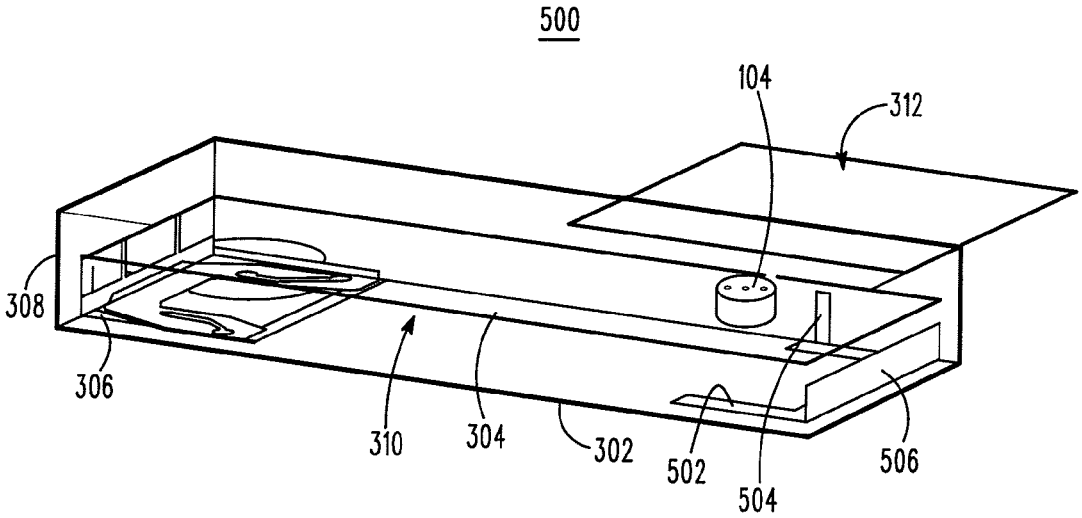
FIG. 5 is a perspective view of an RF simulation model of a "candy bar" wireless handset with the field shaping conductor used in embodiments of the invention.

FIG. 5 is a perspective view of an RF simulation model of a wireless handset 500 with an embodiment of the field shaping conductor 502 according to the invention. As shown the field shaping conductor 502 is a two-dimensionally extended sheet like structure that is spaced from the ground plane 304 but includes a depending bridge conductor 504 that connects to the ground plane 304 and also includes a depending portion 506 that bends toward the ground plane 304 but does not contact the ground plane 304. This depending portion 506 serves to increase the capacitance between the field shaping conductor 502 and ground plane 304.

Figure 6:
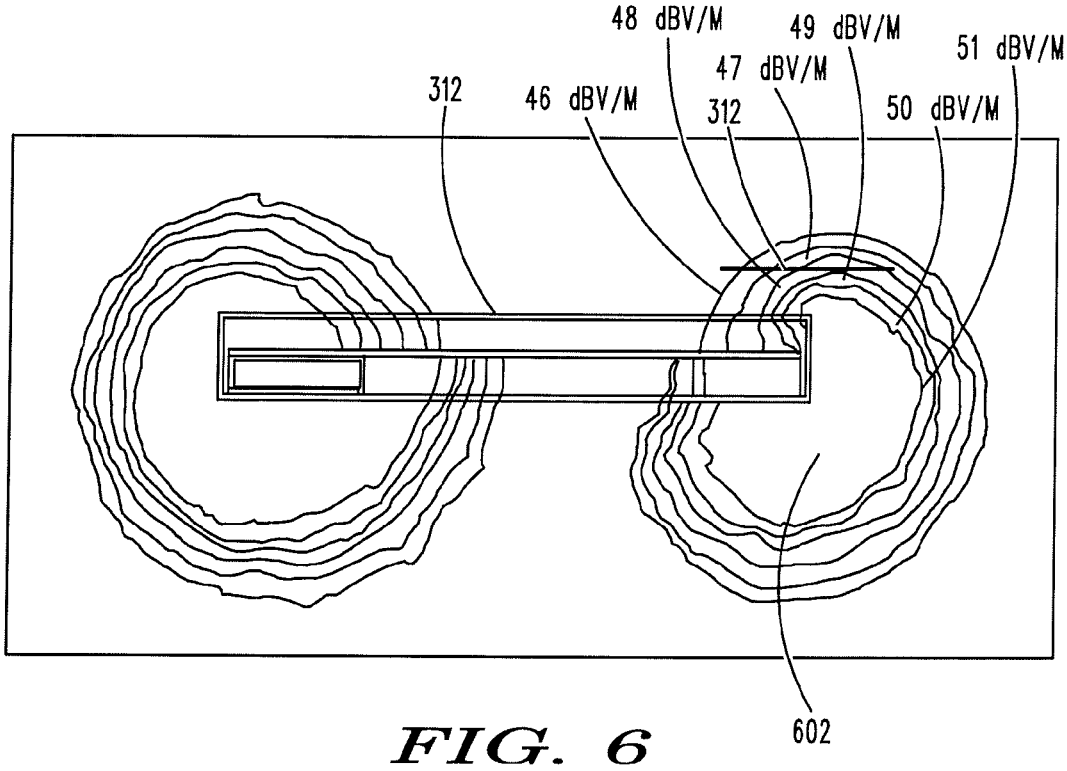
FIG. 6 is a side elevation view of the model shown in FIG. 5 with a superposed contour plot of the electric field re-shaped by the field shaping conductor.

FIG. 6 is a side elevation view of the model shown in FIG. 5 with a superposed contour plot of the electric field re-shaped by the field shaping conductor 502. As shown in FIG. 6 a high field region 602 (corresponding to the high field region 402) bounded by the contour on which the field strength is 48.1 dBV/m is shifted away from the FCC HAC measurement surface 312. In this case the FCC HAC limits on the electric field strength are met.

Figure 7:
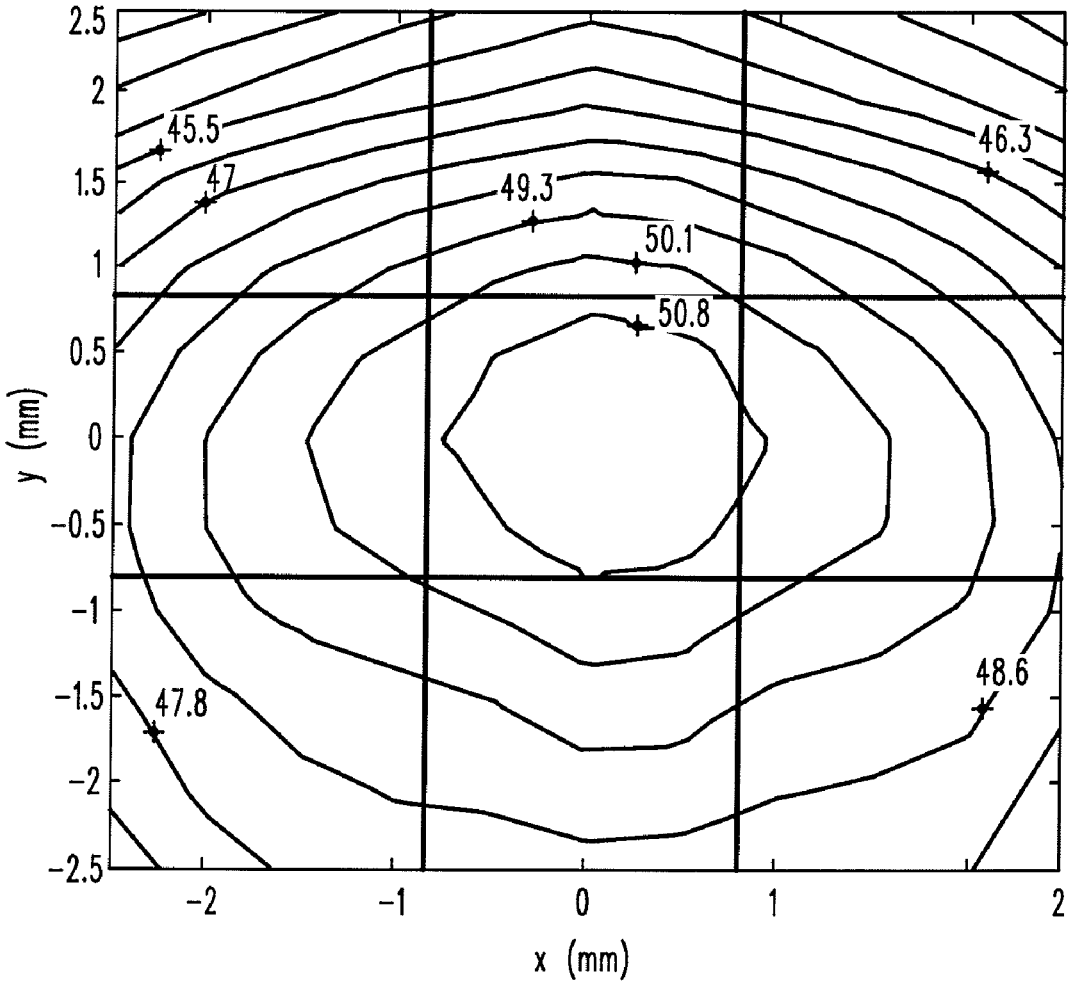
FIG. 7 is a contour plot of measured electric field strength within the FCC specified HAC measurement grid for a wireless handset without the field shaping conductor used in embodiments of the invention.
Figure 8:
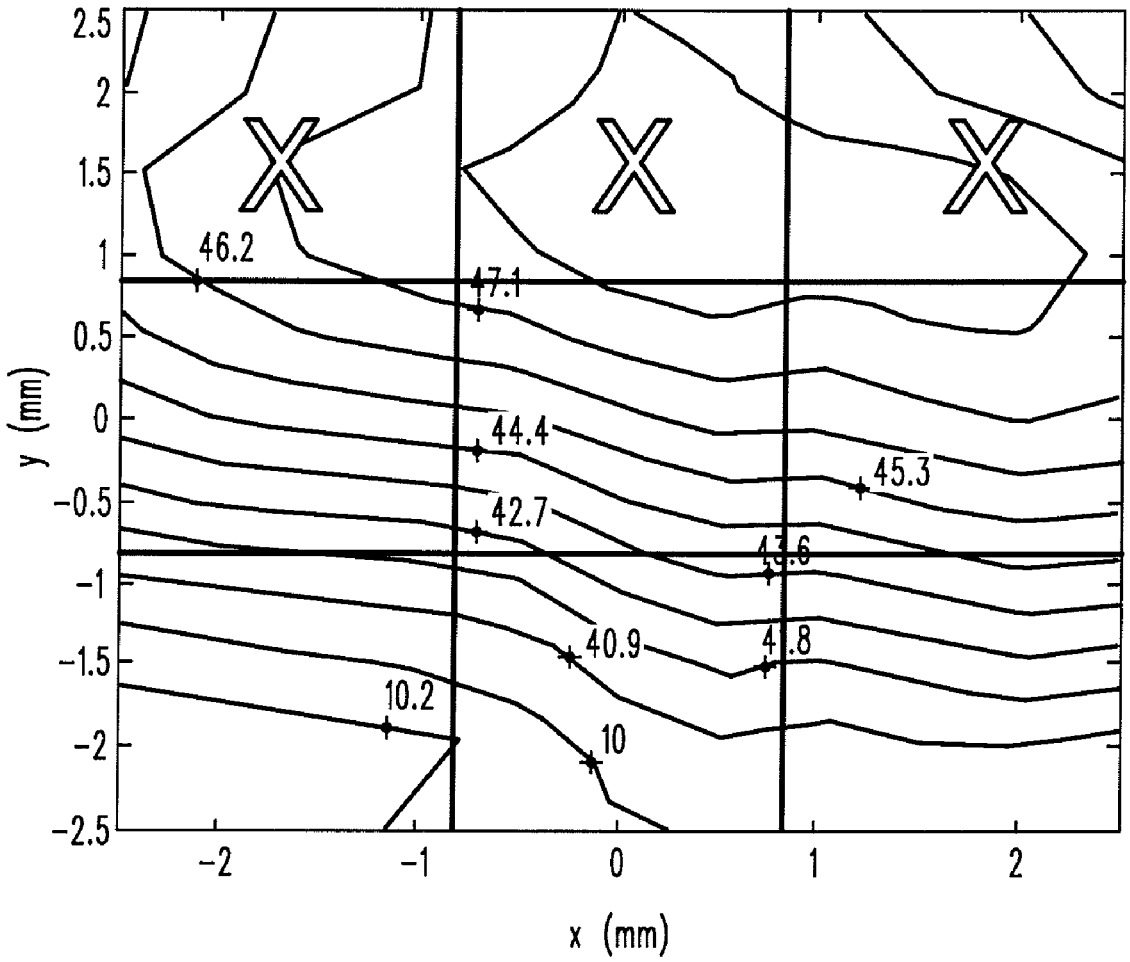
FIG. 8 is a contour plot of measured electric field strength within the FCC specified HAC measurement grid for a wireless handset with the field shaping conductor used in embodiments of the invention.

Whereas FIGS. 4 and 6 show the results of RF simulation, FIGS. 7-8 show the results of measurements.

FIG. 7 is a contour plot of measured electric field strength within the FCC specified HAC measurement grid for a wireless handset without the field shaping conductor used in embodiments of the invention. As shown in FIG. 7 there is an electric field peak in the center of the FCC HAC grid which is centered on the cellular telephone earpiece speaker. In this case the wireless handset would not meet the FCC HAC requirements.

FIG. 8 is a contour plot of measured electric field strength within the FCC specified HAC measurement grid for a wireless handset with the field shaping conductor 226. In this case the electric field peak is shifted up to the center square in the top row of the HAC grid. Because the FCC HAC rules allow three squares of the grid that form a contiguous are to be excluded from consideration, the top row can be excluded allowing the wireless handset represented in this measurement to pass the FCC HAC requirements. Excluded grid squares in the top row are marked with an "X".

Not only does the field shaping conductor 226, 502 allow "candy bar" wireless handsets to pass the FCC HAC requirements it also enhances the performance of the antenna systems of the handsets. This is demonstrated in FIGS. 9-10.

Figure 9:
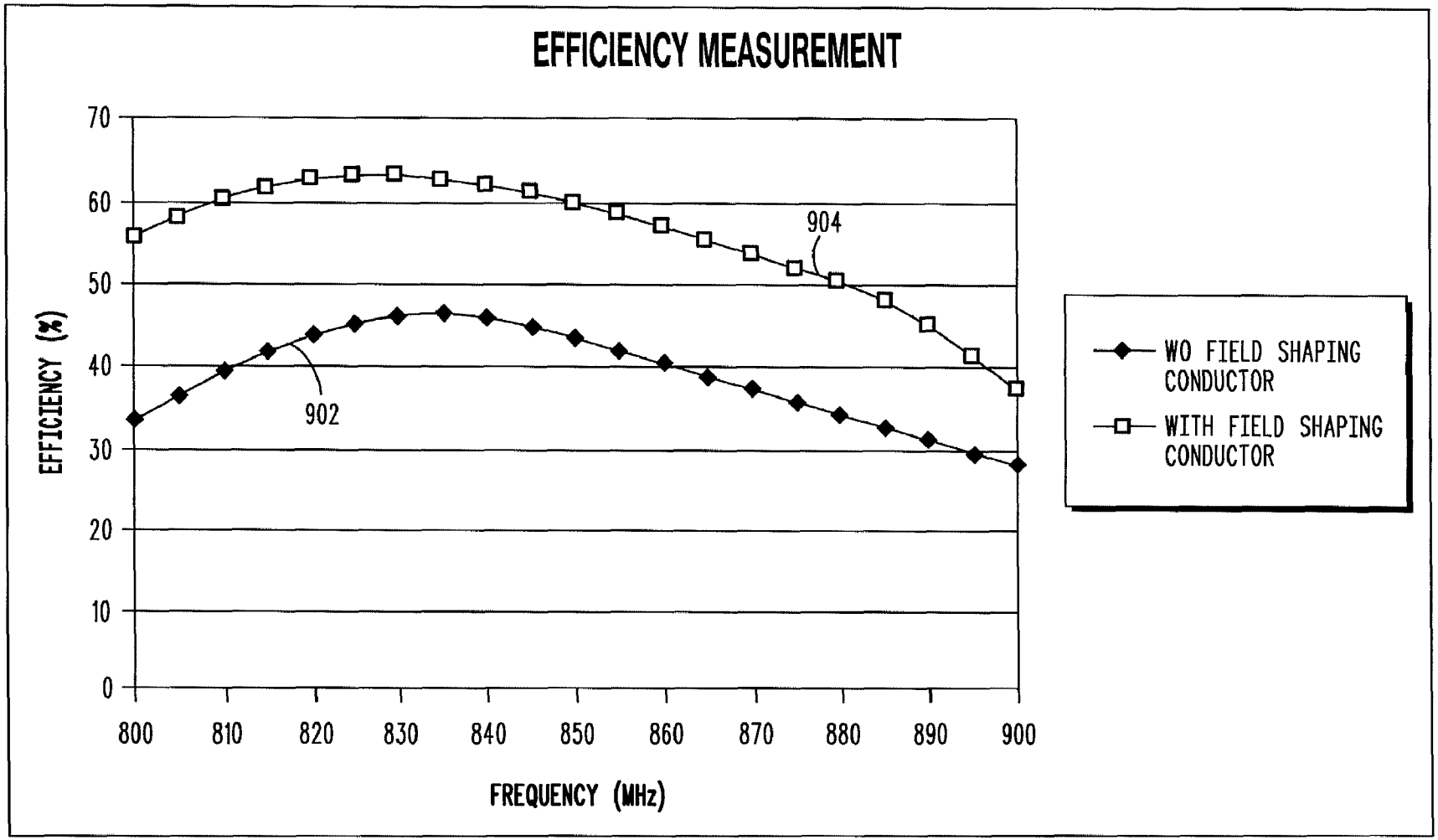
FIG. 9 is a graph of efficiency vs. frequency for wireless handsets with and without the field shaping conductor used in embodiments of the invention.

FIG. 9 is a graph 900 of efficiency vs. frequency for wireless handsets with and without the field shaping conductor 226, 502 used in embodiments of the invention. A first plot 902 is for a wireless handset without the field shaping conductor 226, 502 and a second plot 904 is for the same wireless handset with the field shaping conductor 226, 502. As shown across the frequency range of interest from 800 MHz to 900 MHz (the lower GSM bands) the efficiency is improved by the utilization of the field shaping conductor 226, 502.

Figure 10:
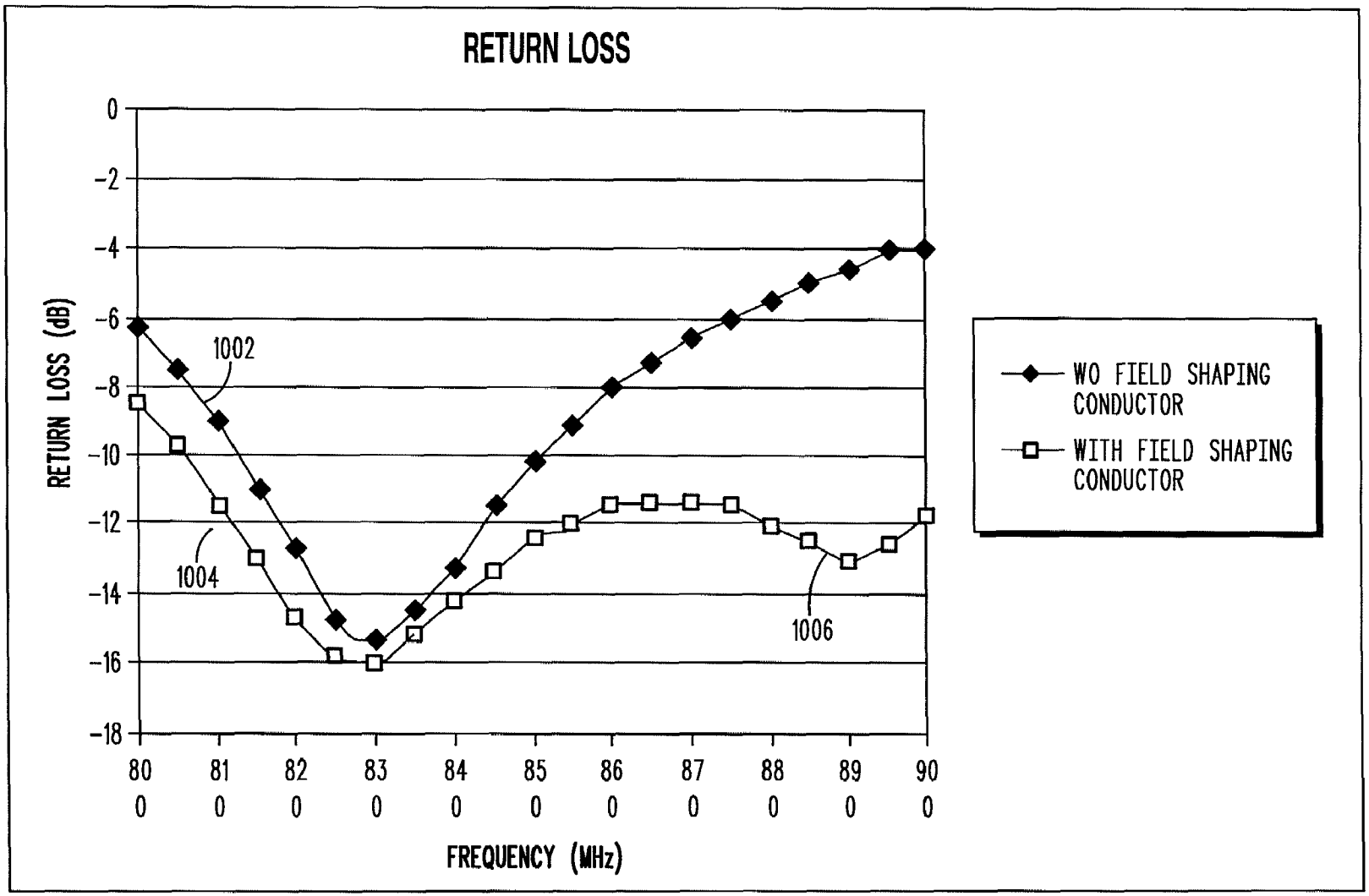
FIG. 10 is a graph of return loss vs. frequency for wireless handsets with and without the field shaping conductor used in embodiments of the invention.

FIG. 10 is a graph 1000 of return loss vs. frequency for wireless handsets with and without the field shaping conductor 226, 502 used in embodiments of the invention. A first plot 1002 is for a wireless handset without the field shaping conductor 226, 502 and a second plot 1004 is for the same wireless handset with the field shaping conductor 226, 502. As shown across the frequency range of interest from 800 MHz to 900 MHz the return loss is greater (meaning there is less reflected power and more radiated power) when the field shaping conductor 226, 502 is utilized. The field shaping conductor 226 provides additional resonance that leads to a distinct dip 1006 in the return loss plot 1004 and improves antenna performance in the lower GSM band.

Figure 11:
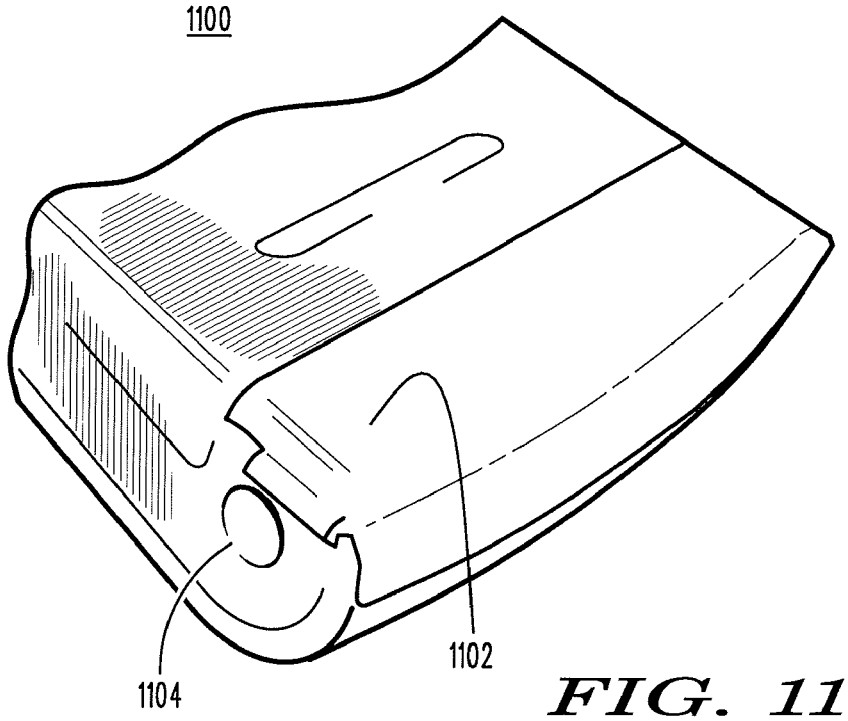
FIGS. 11-12 are two different perspective views of the back of the top end of a wireless handset that has a field shaping conductor outside its housing according to an embodiment of the invention.
Figure 12:
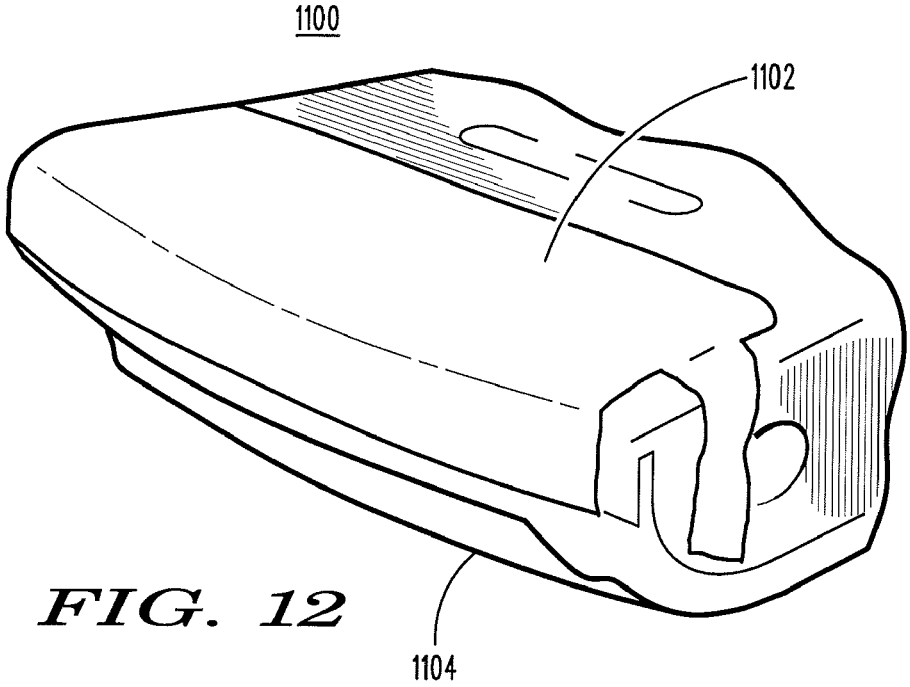

FIGS. 11-12 are two different perspective views of the back of the top end of a wireless handset 1100 according to an embodiment of the invention that has a field shaping conductor 1102 outside its housing 1104. The field shaping conductor 1102. The field shaping conductor 1102 can be a stamped metal piece, bent metal foil or a conductive coating or metalization.

Figure 13:
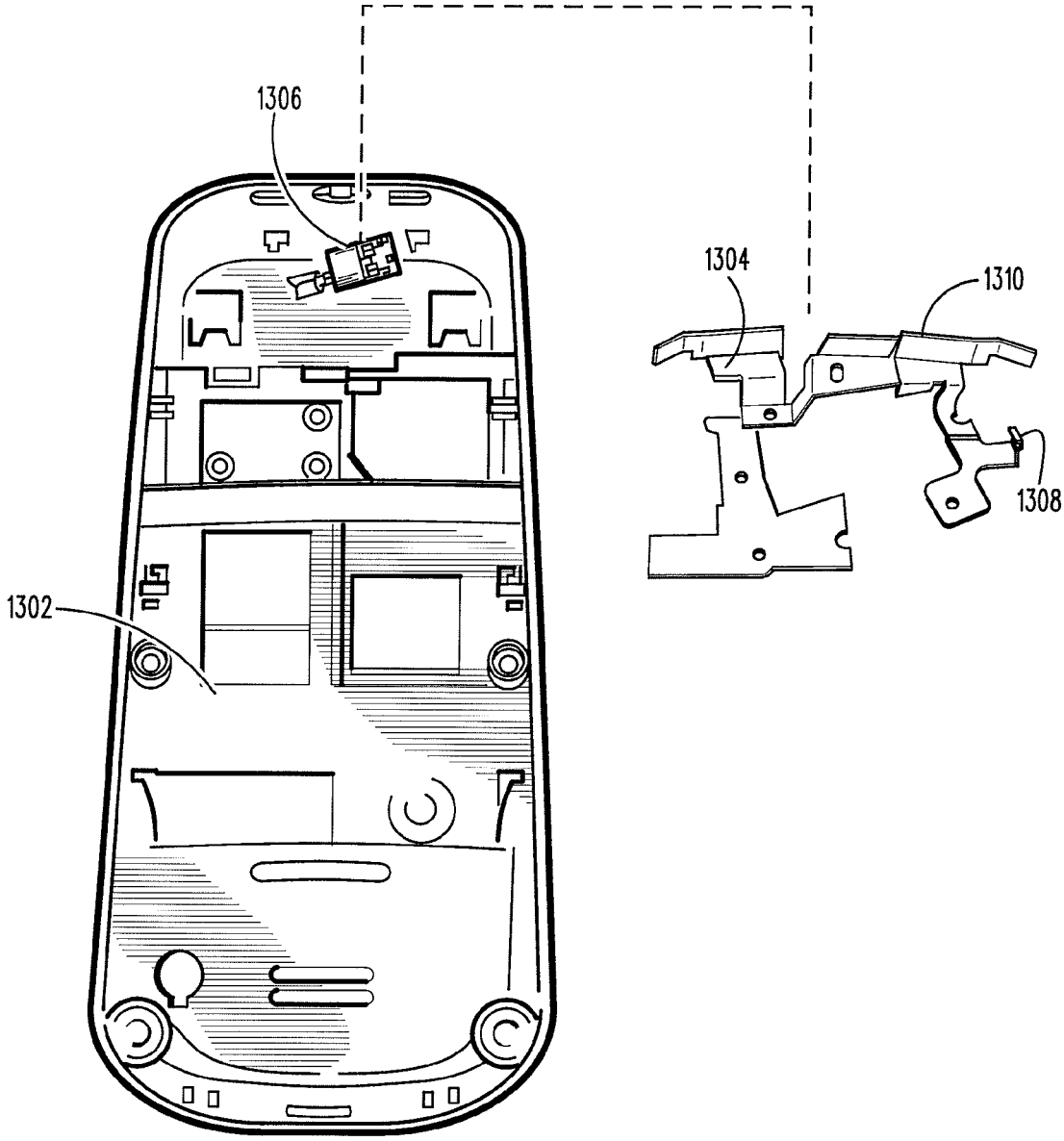
FIG. 13 shows the inside of a wireless handset housing and a differently shaped field shaping conductor according to an alternative embodiment of the invention.

FIG. 13 shows the inside of a rear side of a wireless handset housing 1302 and a differently shaped field shaping conductor 1304 according to an alternative embodiment of the invention. In this case the field shaping conductor 1304 is shaped to closely nest around vibrator motor 1306 that is used as a silent mode alert. In general, the field shaping conductors according to embodiments of the invention can be shaped to accommodate the geometry and positioning of a variety of wireless handset internal components. Note that the field shaping conductor 1304 includes a conductive bridge portion 1308 that in an assembled wireless handset would contact a conductive pad on a circuit board of the wireless handset. Also, note that the field shaping conductor 1304 includes a bent portion 1310 that in an assembled wireless hand set would be bending toward the ground plane within the circuit board and would enhance capacitive coupling between the field shaping conductor 1304 and the ground plane.

For the most part interference with hearing aids is mainly due to signals transmitted from wireless handset, as opposed to resonances in the antenna system that occur when receiving signals. According to some embodiments of the invention the field shaping conductor is tuned so that it has a resonance that overlies a transmit band of the wireless handset. Doing so improves the ability of the field shaping conductor to control hearing aid interference. The field shaping conductor can be tuned by adjusting the dimensions of a capacitance enhancing depending portion (e.g., 506, 1310) or adjusting the dimensions of the conductive bridge (e.g., 230, 504, 1308). In some cases aligning the resonance of the field shaping conductor with the transmit band can degrade the antenna performance in the receive band. In such cases a Transmit/Receive (T/R) switch can be used to avoid degrading performance in the receive band.

Figure 14:
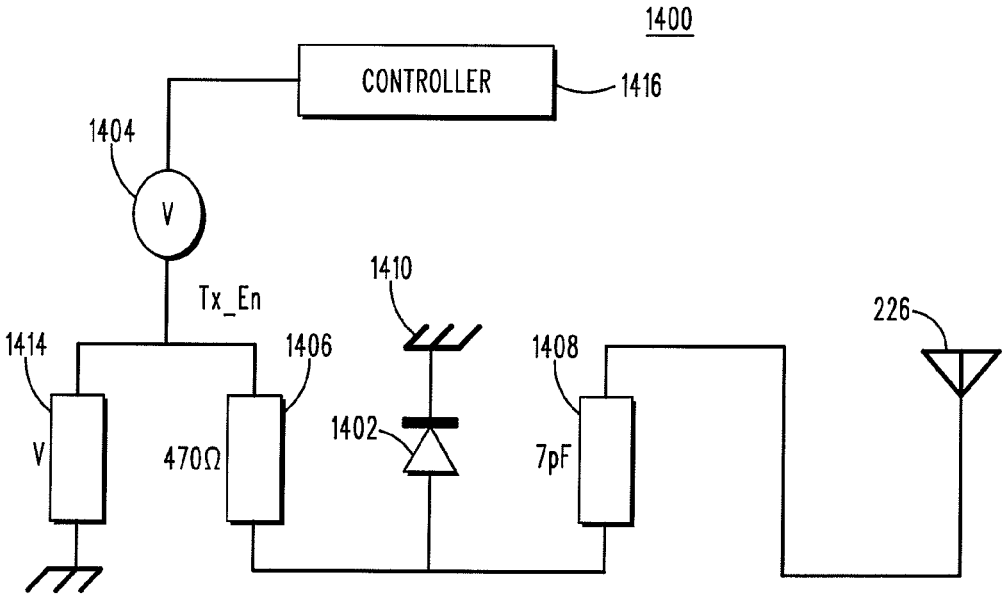
FIG. 14 is a schematic circuit diagram for a T/R switch for the field shaping conductor according to an embodiment of the invention.

FIG. 14 is a schematic of a T/R switch 1402 circuit 1400 for the field shaping conductor 226 (represented schematically in FIG. 4) according to an embodiment of the invention. The switch 1402 is a diode. A control voltage source 1404 is coupled to the anode of the diode switch 1402 through a resistor 1406 to the switch 1402. The field shaping conductor 226 is coupled to the anode of the diode switch 1402 through a capacitor 1408. The cathode of the diode switch 1402 is coupled to at least one ground plane 1410 (in the main printed circuit board 208) of the wireless handset 200. The switch 1402 is normally closed. Applying a predetermined control voltage to the diode switch turns on the diode allowing RF signals to pass between the field shaping conductor 226 and the ground plane 1410. A varister 1414 connected between ground and the junction of the control voltage source 1404 and the resistor 1406 protects the circuit 1400 from electrostatic discharge damage. A controller 1416 is coupled to and operates the switch 1402.

Figure 15:
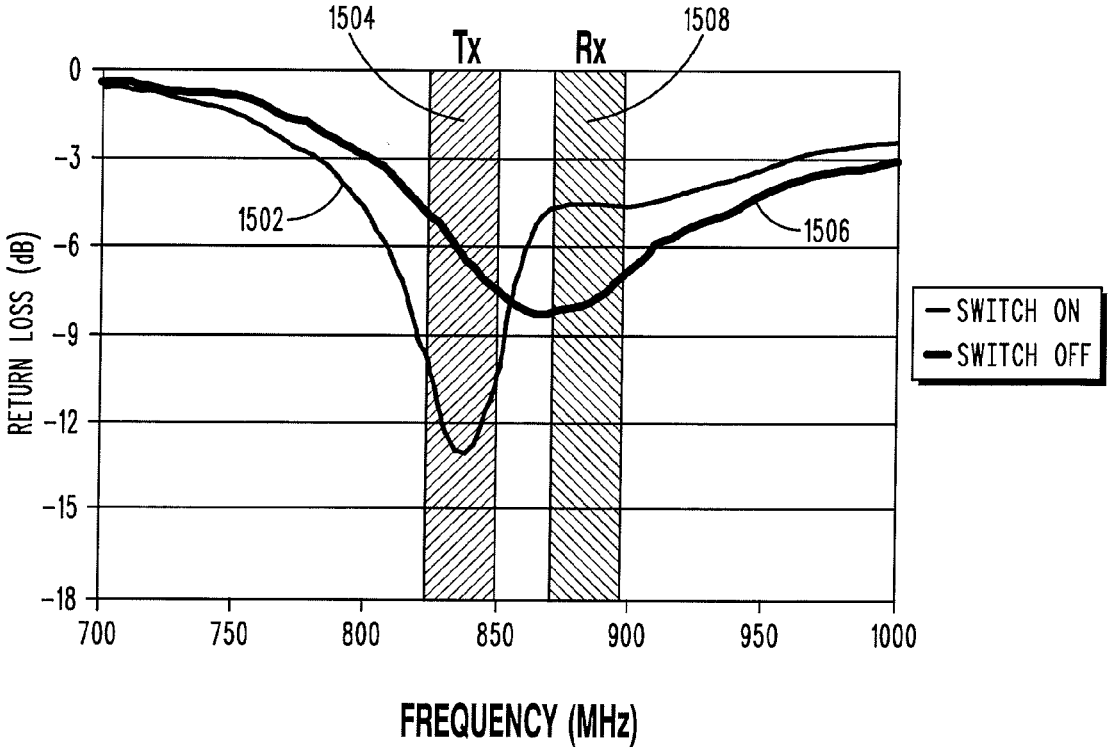
FIG. 15 is a graph including return loss plots for an embodiment that connects the field shaping conductor through a T/R switch.

FIG. 15 is graph 1500 including return loss plots 1502, 1504 for an embodiment that connects the field shaping conductor 226 through the T/R switch 1402. A first plot 1502 is for the switch 1402 in the closed state. In this case performance in a transmit band (Tx) 1504 is good, but performance in the receive band (Rx) is not as good. A second plot 1506 shows the return loss for the switch 1402 in the open state. Opening the switch improves performance in a receive band (Rx) 1508, while closing the switch improves antenna performance and HAC compliance when transmitting. In this embodiment the transmit band 1504 is lower in frequency relative to the receive band 1508

Figure 16:
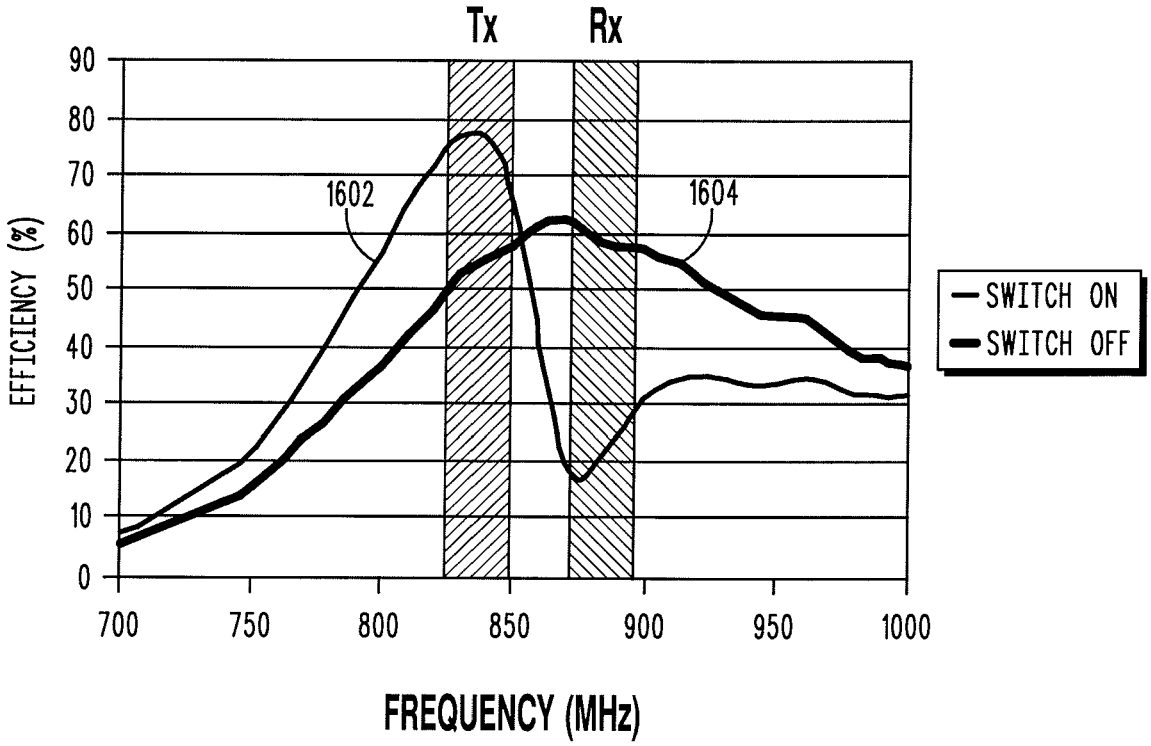
FIG. 16 is graph including a efficiency plots for the embodiment that connects the field shaping conductor through a T/R switch.

FIG. 16 is a graph 1600 including efficiency plots 1602, 1604 for the embodiment that connects the field shaping conductor 226 through the T/R switch 1402. A first plot 1602 is for the switch 1402 in the closed state and a second plot 1604 is for the switch 1402 in the open state. As shown, in the closed state efficiency is higher in the transmit band compared to the receive band and in the open state efficiency in the receive band is improved relative to the closed state.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A wireless handset comprising:

a housing comprising a top end and a bottom end, a front side and a rear side;

an antenna counterpoise comprising a printed circuit board disposed in said housing between said front side and said rear side wherein said printed circuit board comprises at least one ground plane;

an earpiece speaker disposed proximate said top end of said housing facing said front side of said housing;

an internal antenna disposed in said housing proximate said bottom end wherein said internal antenna is coupled to the printed circuit board; and a separate field shaping conductor disposed proximate said top end of said housing in spaced relation from said at least one ground plane, wherein said field shaping conductor is coupled to said at least one ground plane by a bridge conductor that extends across to said printed circuit board;

wherein said bridge conductor is connected to said at least one ground plane through a switch; and wherein said internal antenna is tuned to a receive band and said separate field shaping conductor is tuned to provide a resonance in a transmit band and wherein said switch is operable to close upon transmission.

2. The wireless handset according to claim 1 wherein said transmit band is lower in frequency relative to said receive band.

3. The wireless handset according to claim 1 wherein said field shaping conductor is disposed proximate said rear side of said housing.

4. The wireless handset according to claim 1 wherein said field shaping conductor has capacitance enhancing portion that bends toward said at least one ground plane.

5. The wireless handset according to claim 1 wherein said field shaping conductor is two-dimensionally extended.

6. The wireless handset according to claim 3 wherein said field shaping conductor comprises sheet metal.

7. The wireless handset according to claim 1 wherein said internal antenna is a folded inverted conformal antenna.

8. The wireless handset according to claim 1 wherein said field shaping conductor is shaped to conform in shape to a portion of said housing.

* * * * *